United States Patent [19]

Wilson

[11] 4,422,468

[45] Dec. 27, 1983

[54] CANOPY FOR USE WITH AN UMBRELLA

[76] Inventor: George W. Wilson, 5042 13th St., NE., Washington, D.C. 20017

[21] Appl. No.: 351,903

[22] Filed: Feb. 24, 1982

[51] Int. Cl.[3] ..... E04F 10/00

[52] U.S. Cl. ..... 135/97; 135/98; 135/119; 135/DIG. 8

[58] Field of Search ..... 135/16, 94, 98, 99, 135/114, 115, 117, 119, 97, 90, 96, 93, DIG. 8

[56] References Cited

U.S. PATENT DOCUMENTS

| | | | |
|---|---|---|---|
| 394,262 | 12/1888 | Gentzen | 135/117 |
| 1,699,094 | 1/1929 | Chadirjian et al. | 135/117 |
| 1,900,274 | 3/1933 | Brockie | 135/90 |

*Primary Examiner*—Richard J. Apley
*Assistant Examiner*—Stephen R. Crow
*Attorney, Agent, or Firm*—Blair, Brown & Kreten

[57] ABSTRACT

A lawn umbrella expansion device in which an enlarged canopy is provided with a centrally disposed pole cap to engage the tip of an umbrella pole and thereafter be unfurled and stabilized with canopy poles to provide a greatly increased containment area.

5 Claims, 5 Drawing Figures

FIG 1
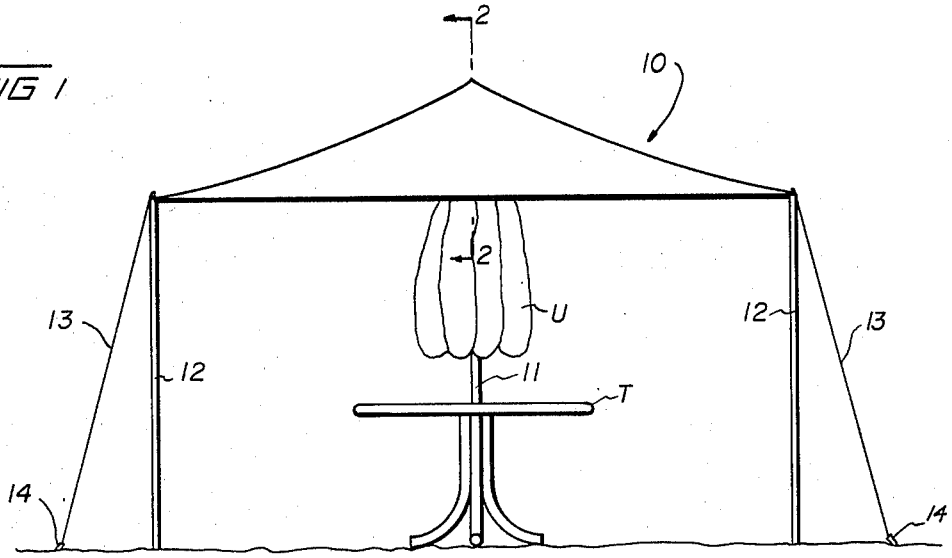
FIG 2
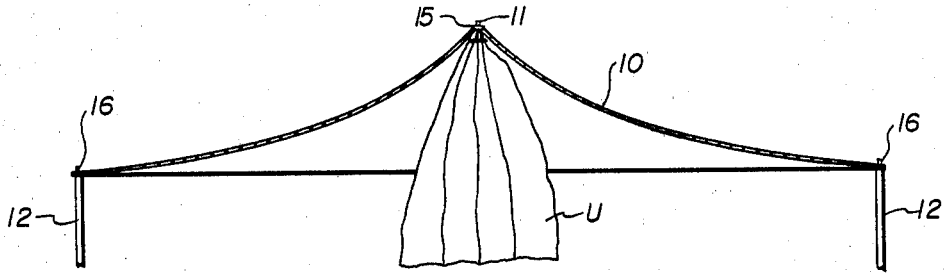
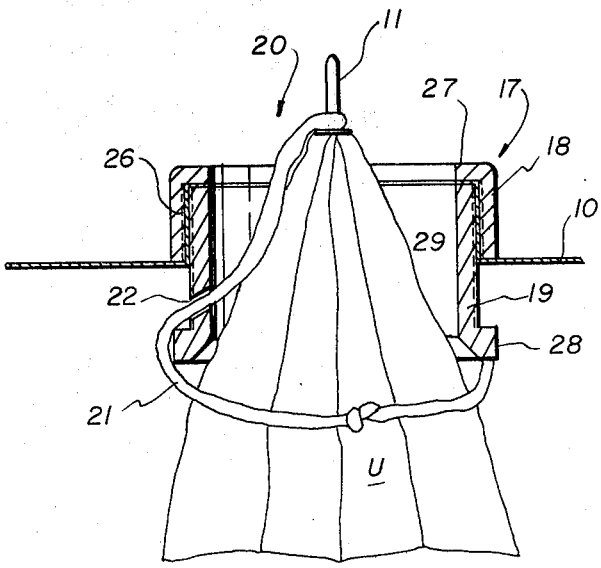
FIG 3
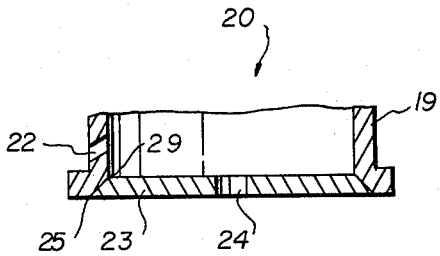
FIG 4
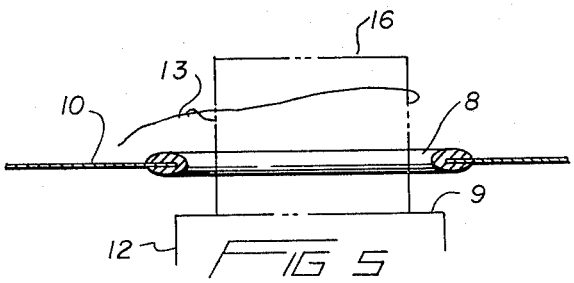
FIG 5

CANOPY FOR USE WITH AN UMBRELLA

BACKGROUND OF THE INVENTION

The present invention relates generally to canopies or the like, and more specifically to an umbrella expansion device to increase the penumbra of the umbrella coverage.

It is a common occurrence that during a family gathering or the like such as a picnic, that a sudden change in weather resulting in inclemency causes the participants to retreat to more secure quarters. During the ensuing scramble for dry quarters any accompanying foodstuffs gathered up by the people usually get wet.

The instant invention is designed to be used in conjunction with a lawn umbrella which may or may not emerge from the center of a lawn table. The umbrella extension according to the instant application can be deployed in minutes and covers enough area so that a retreat from the outdoor activities becomes unnecessary. This fulfills a strong felt yet unfulfilled need for the capacity to greatly expand the penumbra of a lawn umbrella or the like.

The following patents reflect the state of the art of which applicant is aware insofar as these patents appear to be germane to the patent process:
U.S. Pat. No. 369,493, Averill et al.; U.S. Pat. No. 1,774,909, Wells; U.S. Pat. No. 1,219,905, Barringer; U.S. Pat. No. 2,137,625, Norvell; U.S. Pat. No. 1,669,611, Goldberg; U.S. Pat. No. 2,777,454, Kramer; U.S. Pat. No. 1,673,657, Woltjes; and U.S. Pat. No. 2,988,069, Otto.

As can be observed from the cited references the prior art concerning tent canopies is quite prolific. Of the references cited the patent to Barringer would appear to be germane since he teaches the use of a table with a centrally disposed pole from which arises a canopy. The canopy then can be employed in conjunction with vertically disposed sheets 29 to completely enclose the area directly beneath the canopy, the entire unit thereafter becoming a tent.

Similarly, the patent to Wells would appear to be of interest since he teaches the use of an umbrella with a peripheral drop sheet or curtain 13 which encloses an area defined by the perimeter of the umbrella. The instant application is distinguished in that it is designed to be employed in conjunction with a lawn umbrella and thereby greatly extend the zone of protection and afford an easy method for creating an enlarged canopy to prevent any inclemency from interfering with any outdoor affairs. The device according to the instant application is provided with a centrally disposed support area which is designed to accept umbrella poles of various diameters, thereby allowing the instant invention to be deployed in conjunction with lawn umbrellas of various sizes and shapes.

The other references cited further delineate the state of the art.

SUMMARY AND OBJECTS OF THE INVENTION

Accordingly, it is a primary object of the present invention to provide a novel umbrella expansion device which greatly increases the containment area to allow outdoor gatherings, such as a picnic, to continue even during inclement weather.

It is another object of the present invention to provide a novel umbrella expansion device which can be quickly deployed so that a minimal amount of moisture falls before the containment area is greatly increased.

It is a further object of the invention to provide a novel umbrella expansion device which is easily adaptable to outdoor umbrellas of various types and diameters.

It is a still further object of the present invention to provide a novel umbrella expansion device which is durable, safe to use, and extremely easy to deploy.

It is still another object of the present invention to provide a novel umbrella expansion device which is easy to manufacture and lends itself well to mass production techniques.

These and other objects are accomplished by the provision of a canopy with a central support area adaptable to a center pole for an umbrella and further provided with a series of poles and pegs which allow expansion of the penumbra of a lawn umbrella.

Other objects and advantages of this invention will become apparent when viewed in light of the following description when taken in conjunction with the accompanying drawings.

BRIEF DESCRIPTION OF THE DRAWING FIGURES

FIG. 1 is a side view of the invention as it would appear deployed over a combination lawn table and umbrella.

FIG. 2 is a cross-sectional view taken along lines 2—2.

FIG. 3 is sectional view of the support area employing the pole cap.

FIG. 4 is a sectional view of the pole cap with the adapter plate deployed therein.

FIG. 5 is a sectional view of a grommet deployed in the canopy material.

DESCRIPTION OF THE PREFERRED EMBODIMENT

Referring now to the drawings in detail wherein like reference numerals represent like parts throughout the several figures, reference numeral 10 refers generally to the invention according to the instant application.

As shown in FIG. 1 a lawn umbrella U has a center pole 11 disposed through the center of a lawn table T. Several canopy poles 12 are peripherally disposed around the tarp or canopy 10 and secured by ropes 13 and pegs 14. The tarp which defines the canopy 10 may be constructed from any strong, water-resistant fabric or material such as nylon.

As shown in FIG. 2, the umbrella is disposed in a closed position and the center pole 11 extends from the apex of the umbrella U and provides a support member around which the center support area 15 of the canopy 10 is disposed. As shown in FIG. 5, an upper extremity of the canopy pole 12 has a shoulder 9 which creates a stepped-down protrusion or peg 16 on the top of the pole which freely engages the grommet 8 which rests upon the shoulder 9. The canopy rope 13 is looped over the peg 16 which prevents the canopy grommet 8 from disengaging from the peg 16 in case of an uplifting gust of wind. A pole cap, generally referred to by the reference numeral 17, is disposed in the central support area 15 to accept the umbrella pole 11. The pole cap 17 is a hollow, two piece cylinder with a top collar 18 which fits around a lower collar 19 with the canopy 10 firmly captured therebetween. In a preferred embodiment the top collar 18 is a hollow cylinder with threads 26 on the inner sidewall thereof and an inwardly extending top peripheral stop lip 27 to stop the lower collar 19 when the two collars 18 and 19 are threaded together. The lower collar 19 is a smaller diameter hollow cylinder with threads 27 on the outer sidewall thereof for threaded engagement with the upper collar 18. Together the upper collar 18 and the lower collar 19 define a central bore 20 in the support area 15 which receives the umbrella pole 11. The lower collar 19 has an outwardly extending peripheral lip 28 and is provided with a bevelled surface 29 to mate with and engage a similar bevelled surface 25 on an adapter plate 23, as shown in FIG. 4. The pole adapter plate 23, consists of a disc with a bevelled peripheral edge 25, as described above, that fits into the lower collar 19. A central aperture 24 in the plate 23 reduces the size of the central bore 20 in the pole cap 17 so that an umbrella 11 pole of a smaller diameter can be accommodated. The two collars 18 and 19 provide a central aperture 20 in the canopy 10 in order to receive the umbrella pole 11.

A tie down string 21 runs through an aperture 22 in the sidewall of the lower collar 19 and is looped over the top of the umbrella pole 11 while an opposite end of the string 21 is tied around the umbrella U which prevents a gust of wind from disengaging the pole cap 17 from the pole 11.

In a further embodiment, the central support area maybe defined by a grommet 8, similar to that pictured in FIG. 5, instead of of a pole cap 17.

In use and operation, the umbrella U is lowered so that the top of the umbrella pole 11 is exposed and then the pole cap 17 in the canopy 10 is disposed over the top of the pole 11. Thereafter, the canopy 10 is unfurled and drawn taut into a position where the canopy poles 12 and support ropes 13 along with the associated pegs 14 are deployed and the completed canopy 10 is secured and provides a greatly increased containment area.

Having thus described the preferred embodiment of the invention, it should be understood that numerous structural modifications and adaptations may be resorted to without departing from the spirit of the invention.

What is claimed is:

1. A canopy comprising in combination:

an umbrella having a lower support stand, a pole and an upper fabric covering, a tarp having a surface area substantially greater than the fabric covering, means connecting said tarp to the umbrella, and means holding said tarp along its edges in an elevated position, whereby said canopy serves as an adjunct to the umbrella, protecting a comparatively greater area from weather wherein said holding means comprises in combination, peripherally disposed grommets in said tarp, canopy poles with stepped down protrusions at an upper extremity to engage said grommets, and ropes with pegs extending from said protrusions to the ground to provide support for said tarp wherein said connecting means comprises a pole cap including a hollow, cylindrical upper collar with an inwardly extending, horizontal stop lip at an upper extremity and threads disposed on an inner sidewall thereof, a hollow, cylindrical lower collar with an outwardly extending horizontal lip at a lower extremity thereof and a bevelled surface opposing said lip further including threads on an outer sidewall thereof for threaded engagement with said upper collar with said tarp captured therebetween, said upper collar and said lower collar defining a central bore in said canopy to engage the pole of the umbrella.

2. The device of claim 1 wherein said pole cap includes a tie down string disposed through an aperture in a sidewall of said lower collar, said tie down including a loop at an extremity to engage the umbrella pole above said canopy, the other extremity of said tie down being secured to the umbrella pole below said canopy whereby said tie down secures said canopy to the umbrella pole preventing uplifting gusts of wind from disengaging same.

3. The device of claim 2 wherein said pole cap includes an adapter plate formed from a disc with a bevelled peripheral edge dimensioned to engage said bevelled surface on said lower collar and further provided with a centrally disposed aperture of a smaller diameter than said central bore is said pole cap, whereby said pole cap in conjunction with said adapter plate can receive umbrella poles of lesser diameter.

4. The device of claim 3 wherein said tarp is constructed from water resistant, rip proof nylon fabric.

5. A canopy comprising in combination:

an umbrella having a lower support stand, a pole and an upper fabric covering, a tarp having a surface area substantially greater than the fabric covering, means connecting said tarp to the umbrella, and means holding said tarp along its edges in an elevated position, whereby said canopy serves as an adjunct to the umbrella, protecting a comparatively greater area from weather wherein said holding means comprises in combination, peripherally disposed grommets in said tarp, canopy poles with stepped down protrusions at an upper extremity to engage said grommets, and ropes with pegs extending from said protrusions to the ground to provide support for said tarp wherein said connecting means comprises a pole cap including a hollow, cylindrical upper collar with stop means at an upper extremity and threads disposed on an inner sidewall thereof, a hollow cylindrical lower collar having threads on an outer sidewall thereof for threaded engagement with said upper collar and said tarp captured therebetween, said upper collar and said lower collar defining a central bore in said canopy to engage the pole of the umbrella.

* * * * *